United States Patent [19]

Elley

[11] 4,329,080

[45] May 11, 1982

[54] JOINT FORMER

[75] Inventor: John E. Elley, Henrietta, N.Y.

[73] Assignee: Schlegel Corporation, Rochester, N.Y.

[21] Appl. No.: 186,013

[22] Filed: Sep. 15, 1980

[51] Int. Cl.[3] ..... E01C 11/02

[52] U.S. Cl. ..... 404/74; 404/48; 404/64; 52/396

[58] Field of Search ..... 404/65, 48, 69, 47, 404/64, 74; 52/396, 403; 49/482

[56] References Cited

U.S. PATENT DOCUMENTS

| | | | |
|---|---|---|---|
| 2,540,251 | 2/1951 | Fischer | 404/47 |
| 2,901,904 | 9/1959 | Wey | 52/396 |
| 3,280,525 | 10/1966 | Crowley | 52/396 X |
| 3,352,217 | 11/1967 | Peters | 404/65 |
| 3,411,260 | 11/1968 | Dill | 404/48 X |
| 3,782,846 | 1/1974 | Johnson | 404/48 |
| 3,838,930 | 10/1974 | Kock | 404/48 |
| 3,871,787 | 3/1975 | Stegmeier | 404/48 |
| 4,090,800 | 5/1978 | Koch | 404/48 |

*Primary Examiner*—Nile C. Byers, Jr.

*Attorney, Agent, or Firm*—Cushman, Darby & Cushman

[57] ABSTRACT

A joint former for hardenable material such as concrete comprises two essentially identical web members which are releasably attached to each other by a two-part friction coupling to form an assembly which is generally a T-shaped assembly. Each web is configured along at least one edge to form a first coupling part and along a central portion of at least one surface to form a second complementary coupling part so that any two of such webs can be attached to each other to provide a T-shaped assembly. In use the web forming the body of the T is inserted into the hardenable material, the bar web serving to align and position the inserted web. The bar web is then detached from the inserted web and releasably attached to another essentially identical web to form another T-shaped assembly suitable for use in the manner just described.

8 Claims, 3 Drawing Figures

JOINT FORMER

This invention relates to devices and techniques for forming surface joints or lines of weakness in hardenable material, such as concrete. In particular, it relates to a special two-piece joint forming assembly of generally T-shaped cross-section formed of two essentially identical web members releasably attached to each other.

BACKGROUND AND PRIOR ART

It is known that joints should be formed in hardenable or settable compositions such as concrete pavements, floors and the like in order to prevent surface cracks resulting from expansion and contraction of the composition during setting and subsequently from temperature changes. One current practice in the art is to form such joints by inserting a joint-former or divider edgewise into the composition while it is in a plastic condition. The joint-former or divider may be, for example, a plastic extrusion which is T-shaped in cross-section with the bar of the T being connected to the body of the T by a frangible connection. The lower section or web which forms the body is inserted vertically downward into the settable material to a level such that upper section or web forming the bar of the T engages the surface of the settable material. Thereafter, the upper section is stripped away from the embedded lower section, breaking the frangible connection and leaving the lower section in place so as to define a line of weakness along which cleavage or fracture of the mass due to shrinkage or settling is more apt to occur than on either side of the line. The stripped-away upper section, that is the section which is used to implant the lower section, is discarded. Such a system is described in U.S. Pat. No. 3,352,217.

Another two-piece joint-former of generally T-shaped cross-section is described in U.S. Pat. No. 4,090,800. In that system the implanting upper section is itself a unitary T-shaped section having a body portion which frictionally engages in a groove in the upper edge of the lower section. After implanting of the lower section the implanting section is removed. A somewhat analogous system is described in U.S. Pat. No. 3,838,930.

Each of the systems summarized above utilizes upper and lower sections which are dissimilar. That is, the implanting or upper section is different in shape from the implanted or lower section. In the system of U.S. Pat. No. 4,090,800 the implanting section is discarded after having been stripped away from the implanted section. This represents an added cost and also presents a trash removal problem in the case of a large concrete pouring project. In the system of U.S. Pat. No. 3,838,930 the upper section which is removed from the implanted lower section is reuseable with another piece of lower section, but the fact that the shapes of the upper and lower sections are different means that supplies of both types of sections must be provided at the construction site.

SUMMARY OF THE INVENTION

The present invention provides a joint-former system which does not involve the waste of a section of the joint former and which does not require that different upper and lower sections be supplied. These advantageous features are achieved by a two-piece joint-forming assembly which is formed of two essentially identical webs or sections releasably attached to each other by a friction coupling such that the upper section after removal from the lower implanted section is reuseable with another identical section to form another assembly. In the preferred embodiment each web or section is generally rectangular in cross-section and is configured along one longitudinal edge to provide a first coupling part. The section is configured along a central longitudinal portion of one side surface to provide a second coupling element which is complementary to the first coupling part. An assembly of generally T-shaped cross-section can thus be formed by connecting the edge of one section to the side of another such section. The friction coupling may be for example, a rib-and-socket, snap-type coupling with the rib projecting from either the edge of the side surface of the section. After the lower section of the assembly has been embedded in the cement or other settable material the upper section is pulled away from the lower embedded section and is attached to another such section. As the pulled-away section may have cement clinging to it this section may conveniently be used as the next section to be embedded. That is, the longitudinal edge of the pulled-away section will conveniently be attached to the side surface of a fresh section.

The sections may be extruded from any suitable plastic material such as polyvinyl chloride. Alternatively they may be formed of extrudable or roll-formable metals such as steel or aluminum.

DETAILED DESCRIPTION

Figure 1:
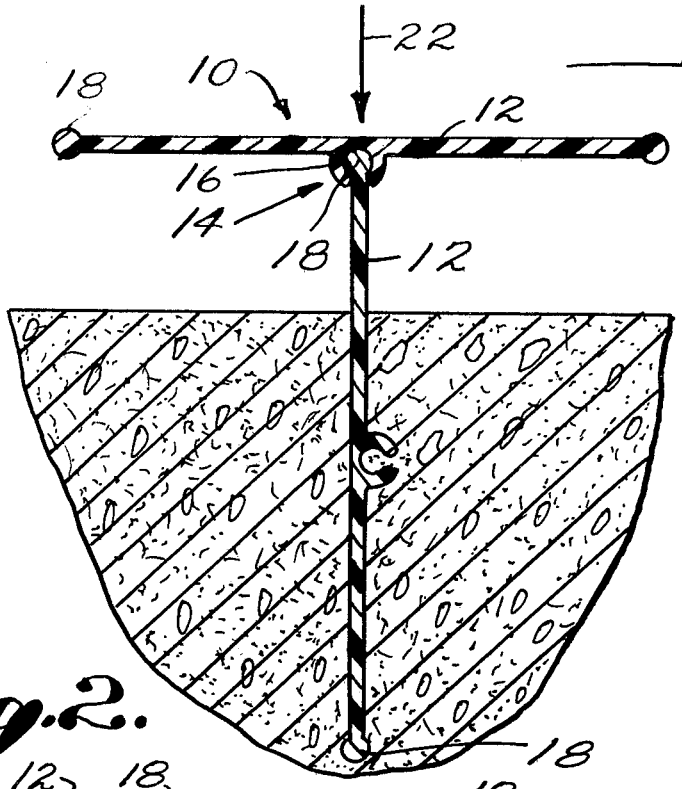
FIG. 1 is a vertical sectional view illustrating the insertion into a mass of concrete of a joint-former assembly embodying the principles of the present invention.

As shown in the drawings a joint-former assembly 10 embodying the principles of the present invention comprises two essentially identical sections 12 attached to each other by a releasable two-part friction coupling 14. Each section 12 is an elongated strip or web of generally rectangular cross-section. In the illustrated embodiment the sections are extruded plastic sections of indefinite length, cut to whatever shorter length is suitable for the jointing project being carried out.

The friction coupling 14 in the illustrated embodiment is a snap-type coupling formed by a socket 16 on the surface of one side of one section 12 and a rib 18 on a longitudinal edge of the other section 12. Preferably each longitudinal edge is provided with a rib 18. If desired, each surface may be provided with a socket 16. The socket 16 is extruded integrally with the section 12 and has the form of a groove running the length of the surface of one side of the section. The rib 18 is also extruded integrally with its section 12. The configuration and location of the parts of the friction coupling 14 are not critical, so long as they form a releasable connection between the joint sections 12 permitting the temporary formation of a joint assembly which is generally T-shaped in cross-section. As each section 12 includes both a socket 16 and a rib 18, any two such sections 12 can be connected together in a T-shaped configuration. As previously indicated it is preferred that a rib 18 be provided along each longitudinal edge of each section 12, so that either edge of one section 12 can be attached to another section. The positions of the socket 16 and the rib 18 can, of course, be reversed. That is, the socket 16 can be provided along a longitudinal edge of each section 12, and the rib can be provided along the surface of one side of the section.

As shown in FIG. 1 the joint assembly 10 is being forced downwardly into a body of wet concrete, in the direction of arrow 22. This can be effected by manually grasping the upper section and using it to guide the lower section as the latter penetrates the wet concrete.

Figure 2:
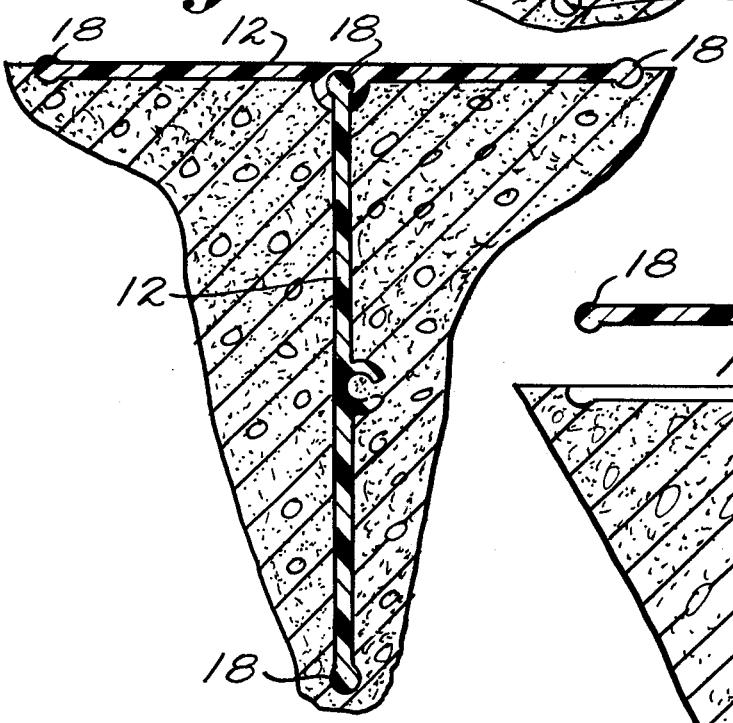
FIG. 2 illustrates the joint-former assembly just after it has been fully inserted.

FIG. 2 illustrates the joint-forming assembly 10 in its fully inserted position. Generally the upper, horizontal section 12 will be pressed down into the concrete so that the upper surface of the section is flush with the surface of the concrete.

Figure 3:
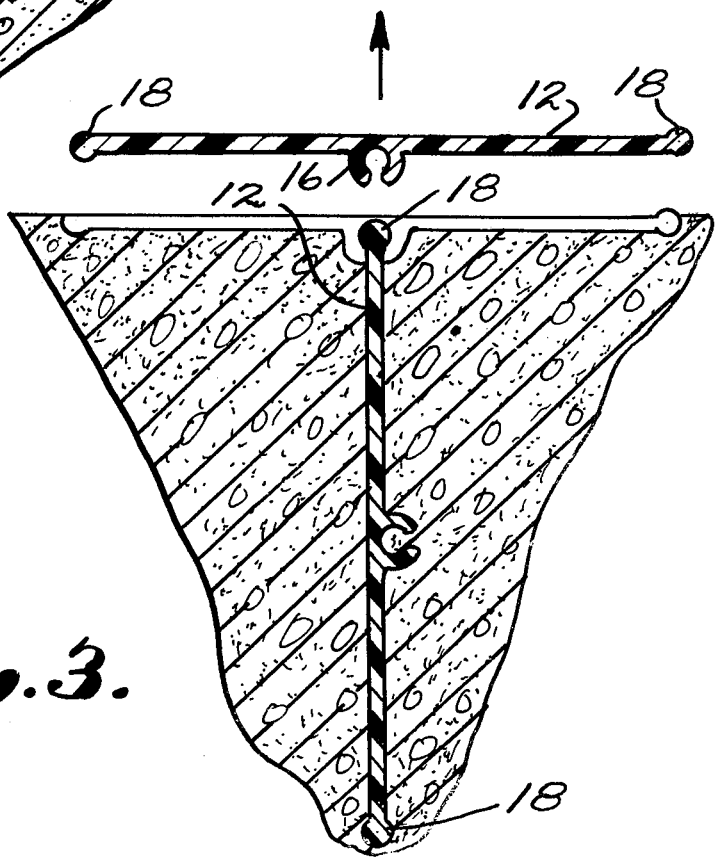
FIG. 3 illustrates removal of the upper section of the joint-former assembly.

FIG. 3 illustrates the step of removing the upper section from the lower embedded section. This may be done manually by pulling upwardly on the upper section so as to separate the two parts of the friction coupling. Generally, the recess left by the upper section in the wet concrete is smoothed over, leaving the lower section completely embedded. The removed upper section is then reused by attaching it to another section thereby creating another T-shaped joint-forming assembly. The attachment is made by frictionally engaging one of the ribs 18 or the socket 16 of the removed section with a complementary part of an identical section. Usually, the attachment will be made such that the previously removed upper section becomes the lower section of the new assembly, because the previously removed section will likely have wet concrete clinging to it and will not be convenient to handle during the next implanting step.

What is claimed is:

1. A joint-former assembly of generally T-shaped cross-section for creating a line of weakness in a mass of hardenable material, said assembly comprising two essentially identical elongated webs releasably secured together by a friction coupling formed by first and second complementary frictionally engageable parts, each web having a first coupling part formed along the length of an edge thereof and a second coupling part formed along the length of a longitudinal center portion of a surface of the web, the first coupling part on one web being releasably engaged with the second coupling part on the other web to thereby form said generally T-shaped assembly, whereby upon insertion of the web forming a body of the T into hardenable material the web forming the bar of the T can be removed and used as either the body web or the bar web of another T-shaped joint-former assembly.

2. A joint-former assembly as in claim 1 wherein one of said coupling part is formed by the walls of a groove and the other coupling part is formed by a rib.

3. A joint-former assembly as in claim 1 or claim 2 wherein each longitudinal edge of each web is provided with a first coupling part.

4. A joint-former web capable of being releasably frictionally coupled to a similar web to thereby form a joint-former assembly of generally T-shaped cross-section for creating a line of weakness in a mass of hardenable material, said web having a longitudinal edge configured as a first friction coupling part and having a longitudinal center portion of one surface configured as a second friction coupling part which is complementary to said first part, whereby said edge of said web can be releasably attached to the web surface of another such web to form a generally T-shaped assembly.

5. A joint-former web as in claim 4 wherein one of said coupling parts is formed by the walls of a groove and wherein the other coupling part is formed by a rib.

6. A joint-former web as in claim 4 or claim 5 wherein each longitudinal edge of said web is provided with a first friction coupling part.

7. A method of forming joints in a mass of hardenable material of plastic consistency comprising forming a two-part assembly of generally T-shaped cross-section by releasably attaching a longitudinal edge of a web member to a longitudinal center portion of a surface of an essentially identical web, said edge and longitudinal center portion being configured to form a two-part releasable friction coupling; inserting the web forming the body of the T into the plastic mass; detaching the web forming the bar of the T; releasably attaching the removed web to another essentially identical web by means of the friction coupling formed by those two webs so as to form a second generally T-shaped assembly; and inserting the web forming the body of the second assembly into hardenable material.

8. A method as in claim 7 wherein the web of said other assembly which is inserted into the mass of material is the web which was detached from said first assembly.

* * * * *